US005569023A

United States Patent [19]

Ishida et al.

[11] Patent Number: 5,569,023

[45] Date of Patent: Oct. 29, 1996

[54] VORTEX BLOWER

[75] Inventors: Fumiaki Ishida, Narashino; Masayuki Fujio, Sakura; Kazuo Kobayashi, Chiba; Kengo Hasegawa, Sakura, all of Japan

[73] Assignee: Hitachi, Ltd., Tokyo, Japan

[21] Appl. No.: 288,904

[22] Filed: Aug. 11, 1994

[30] Foreign Application Priority Data

Aug. 12, 1993 [JP] Japan ..... 5-200732

[51] Int. Cl.[6] ..... F04B 17/00

[52] U.S. Cl. ..... 417/326; 417/423.1; 417/423.12; 417/423.15; 415/55.1

[58] Field of Search ..... 415/55.1, 55.2, 415/55.5; 417/423.1, 423.12, 423.15, 326

[56] References Cited

U.S. PATENT DOCUMENTS

| | | | |
|---|---|---|---|
| 3,844,674 | 10/1974 | Moriyama | 415/55.1 |
| 3,871,797 | 3/1975 | Igarashi et al. | 415/55.1 X |
| 4,231,718 | 11/1980 | Ruhl | 415/55.1 X |
| 4,483,656 | 11/1984 | Abe et al. | 415/55.1 |

FOREIGN PATENT DOCUMENTS

| | | |
|---|---|---|
| 606127 | 8/1948 | United Kingdom . |
| 2126652A | 3/1984 | United Kingdom . |
| 2218285A | 11/1989 | United Kingdom . |

OTHER PUBLICATIONS

World Pumps, No. 7, Jul. 1987, Morden GB p. 201 'motor control using frequency inverters'.

Soviet Inventions Illustrated Section PQ, Week 8639, 9 Oct. 1986 Derwent Publications Ltd., London, GB; Class Q56, AN 86-256875 & SU-A-1 196 532 (Philippov) 7 Dec. 1985 *abstract*.

*Primary Examiner*—Richard E. Gluck

*Attorney, Agent, or Firm*—Antonelli, Terry, Stout & Kraus

[57] ABSTRACT

A vortex blower includes an induction motor and a blower portion driven by the motor. The blower portion includes an impeller and a casing. The impeller is so mounted on a rotary output shaft of the induction motor that the impeller is disposed near the induction motor. The casing is so disposed that the impeller is interposed between the induction motor and the casing. An inlet port and an outlet port are provided on an end of the casing opposite to the induction motor. The blower portion has approximately the same diameter as that of the induction motor.

8 Claims, 16 Drawing Sheets

VORTEX BLOWER

FIELD OF THE INVENTION AND RELATED ART STATEMENT

The present invention relates to a vortex blower for blowing air. A conventional vortex blower of this type is disclosed in Japanese Unexamined Patent Publication No. 51-57011. A conventional vortex blower comprises a motor portion and a blower portion connected thereto. The blower portion includes an impeller driven by the motor portion and a casing having a groove therein and interposed between the impeller and the motor portion. The impeller and the casing define therebetween a working chamber in which air is pressurized.

In a vortex blower, it is necessary that an air inlet means and an air outlet means communicate with the groove of the casing of the blower portion. Therefore, in the conventional formation, the inlet means and the outlet means radially extend outward, or extend along outside of the motor. As a result, the outer diameter of the entire blower is restricted by that of the casing which is larger than the motor portion, and reducing the size of the blower is difficult.

OBJECT AND SUMMARY OF THE INVENTION

It is an object of the present invention to provide a compact vortex blower.

In order to achieve the above object, according to one aspect of the present invention, there is provided a vortex blower, which comprises a motor having an output rotary shaft, a casing having a groove, and an inlet means and an outlet means for working medium, both communicating with said groove, and an impeller having an annular groove in which a plurality of blades or vanes are provided to extend radially to separate the annular groove into a plurality of sections, the impeller being interposed between the motor and the casing, and the annular groove of the impeller being opposite to the groove of the casing so that they cooperate with each other to define therebetween a working chamber for the working medium, with the impeller being directly connected to and driven by the rotary shaft of the motor.

DETAILED DESCRIPTION OF THE PREFERRED EMBODIMENTS

Figure 2:
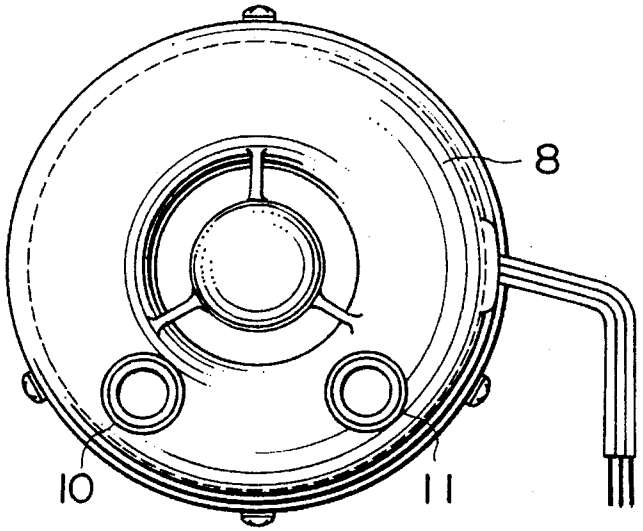
FIG. 2 is a side view of the embodiment of FIG. 1 viewed from lines II—II.
Figure 1:
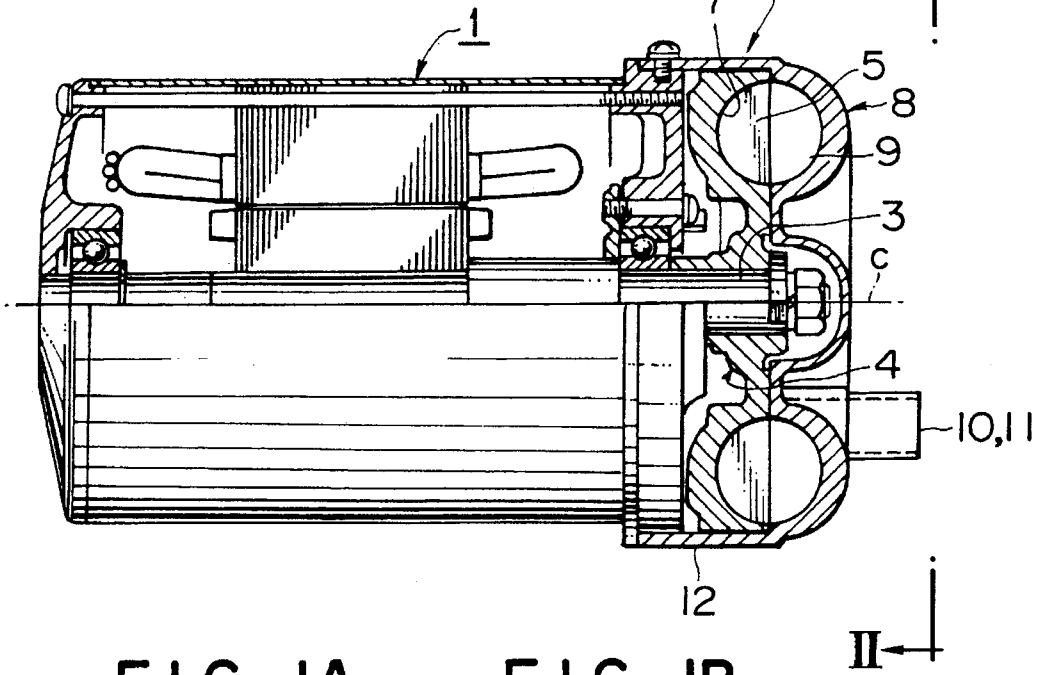
FIG. 1 is a partially cross-sectional view showing a first embodiment of the present invention.

Referring to FIGS. 1 and 2, a vortex blower according to the first embodiment of the present invention comprises a totally-enclosed induction motor 1 and a blower portion 2.

The blower portion 2 includes an impeller 4 and a casing 8 formed by aluminum die-casting, respectively. The impeller 4 is directly mounted to a rotary shaft 3 of the induction motor 1 so as to be driven by the induction motor 1.

The casing 8 is provided with a pressurizing passage 9. The pressurizing passage 9 is formed into annular shape around the center of rotation of the impeller 4, that is, a central axis C of the rotary shaft 3 of the motor 1, but with a blockage so that it is not a full annulus, and is formed as a groove having a semi-circular sectional configuration. An annular groove 7 of the impeller 4 is the annular groove around the central axis C of the rotary shaft 3, and is separated into a plurality of sections in the circumferential direction by a plurality of blades 5. The annular groove 7 presents a semi-circular cross-sectional configuration. The impeller 4 is positioned on the rotary shaft 3 near the induction motor 1, and the casing 8 is positioned apart from the induction motor 1 and provided outside the impeller 4. The impeller 4 is rotatably fitted in the casing 8 to form a working chamber therebetween. The annular groove 7 of the impeller 4 is opened toward the side opposite the induction motor 1, while the pressurizing passage 9 of the casing 8 is opened toward the induction motor 1. An inlet means 10 and an outlet means 11 communicate with the pressurizing passage 9, are formed at the edge face of the casing 8. The inlet means 10 and the outlet means 11 extend in toward the axial direction opposite the induction motor 1 that is, axially outward.

Figure 3:
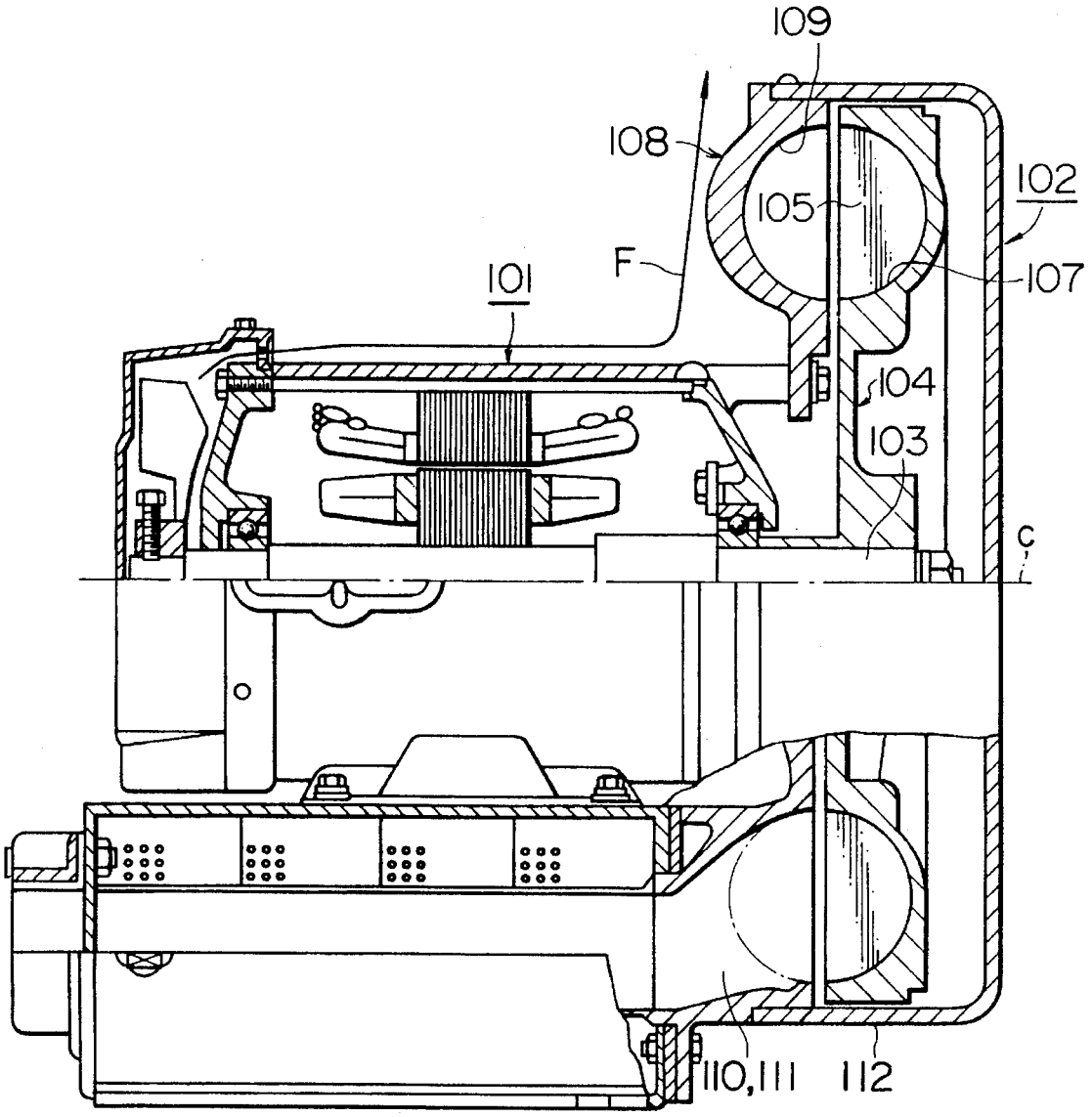
FIG. 3 PRIOR ART
FIG. 3 is a partially cross-sectional view showing a conventional vortex blower.

Contrary to this, in the conventional vortex blower shown in FIG. 3, the impeller 104 is mounted on the rotary shaft 103 so that an opening of the annular groove 107 faces to the induction motor 101, and the casing 108 is mounted between the impeller 104 and the induction motor 101 so that an open side of the pressurizing passage 109 faces to the impeller 104. Therefore, the inlet means 110 and the outlet means 111 communicate with the pressurizing passage 109 of the casing 108 radially extend outward of the induction motor 101, and the outer diameter of the entire blower can not be made smaller, so that the outer diameter of the entire blower must be larger than the outer diameter of the casing, which is larger than that of the induction motor 101.

According to the embodiment of FIGS. 1 and 2, the outer diameter of the blower portion 2 (casing 8) can be equal to that of the induction motor 1 because the inlet means 10 and outlet means 11 need not to be provided around the induction motor 1. Thus, a compact vortex blower may be easily obtained.

According to this embodiment, a cover 112 used in the conventional example of FIG. 3 does not need to be additionally provided, and the casing 8 can be bolted directly to the induction motor 1 through the extended periphery thereof, thereby simplifying formation of the blower. Further, since the impeller 4 is fitted inside the casing 8, pressure leakage can be prevented.

Figure 1B:
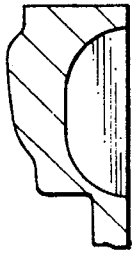
FIGS. 1A and 1B are cutaway cross-sectional views each showing a sectional configuration of a groove.
Figure 1A:
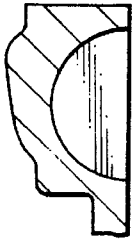

The sectional configuration of the annular groove 7 of the impeller 4 is not limited to a semicircle. The sectional configuration may be formed in a round shape to prevent occurrence of vortex flow of air at both bottom portions of the groove, for example, a semi-ellipse shape (FIG. 1A), and a shape with a straight bottom portion and two quarter-circular corner portions (FIG. 1B) or the like.

Figure 4:
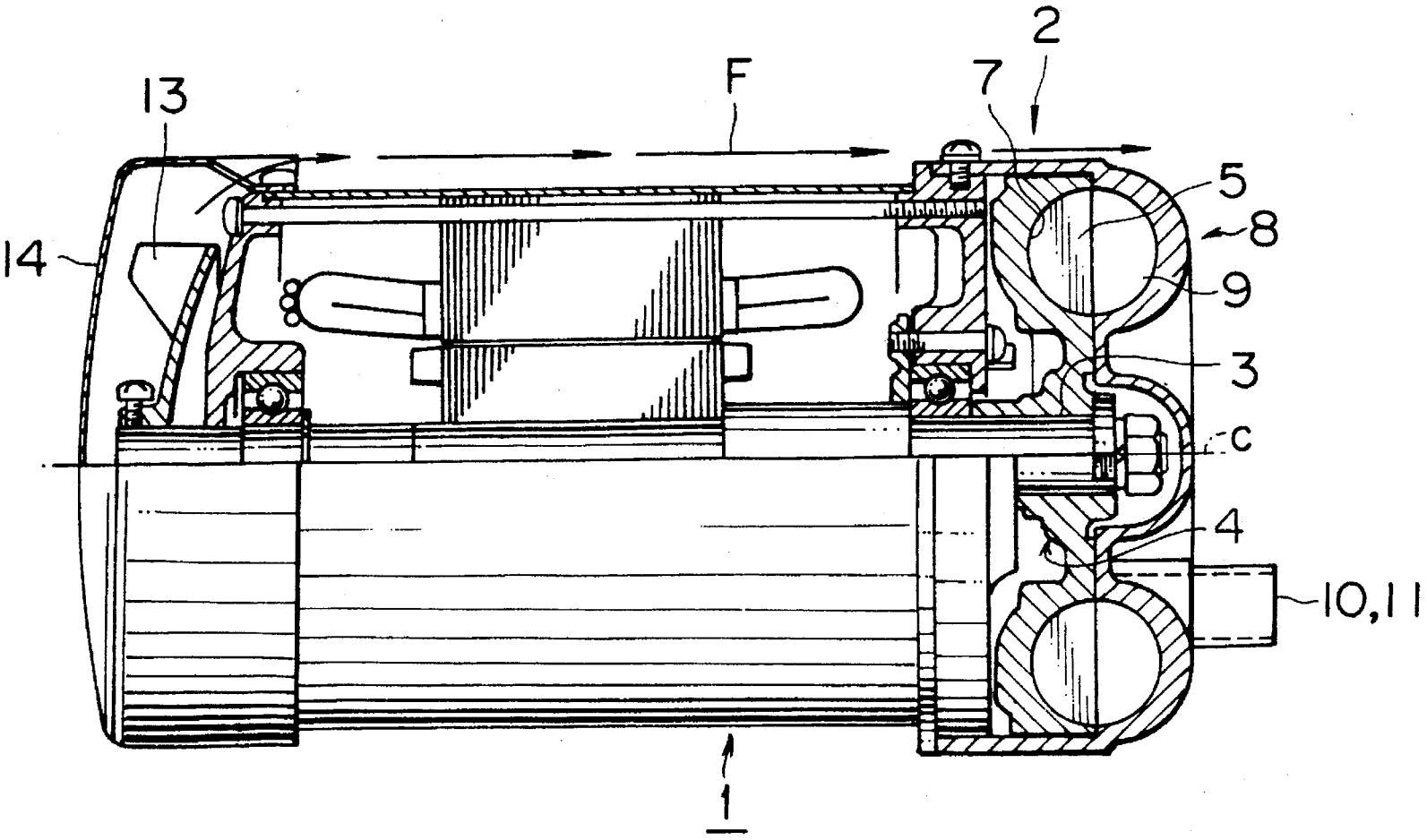
FIG. 4 is a partially cross-sectional view showing a second embodiment of the present invention.

The embodiment of FIG. 4 shows a cooling system of the entire vortex blower.

When the impeller 3 of the blower portion 2 is rotated by the induction motor 1, a cooling fan 13 is also rotated, and a flow of a cooling air F, shown by arrows in the drawing, can be obtained by the action of an end cover 14. By this, the induction motor 1 and the blower portion are forcibly cooled, and a temperature increase may be efficiently controlled. As is well known, the higher the rotary speed of the impeller, or the more the amount of the flow of air may be reduced at the inlet means 10 or the outlet means 11, the more the amount of air friction inside the blower is increased. Therefore, valve heating value in the blower portion 2 is increased, and temperature of the equipment is apt to increase.

Figure 6:
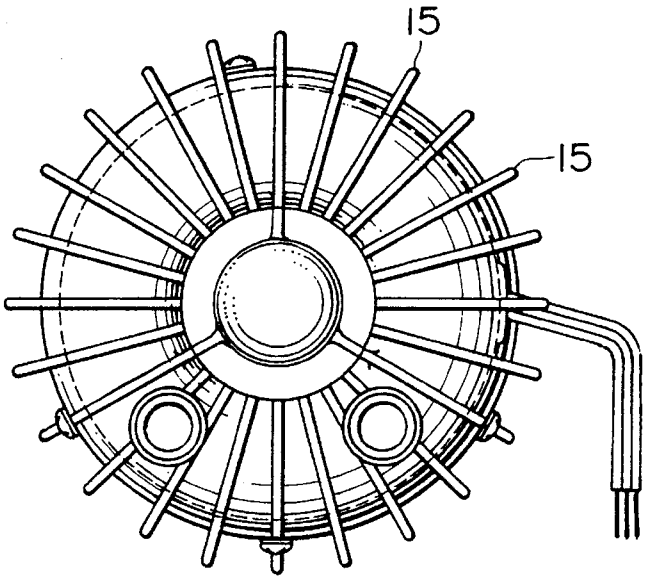
FIG. 6 is a side view of the embodiment of FIG. 5 viewed from the lines VI—VI.
Figure 5:
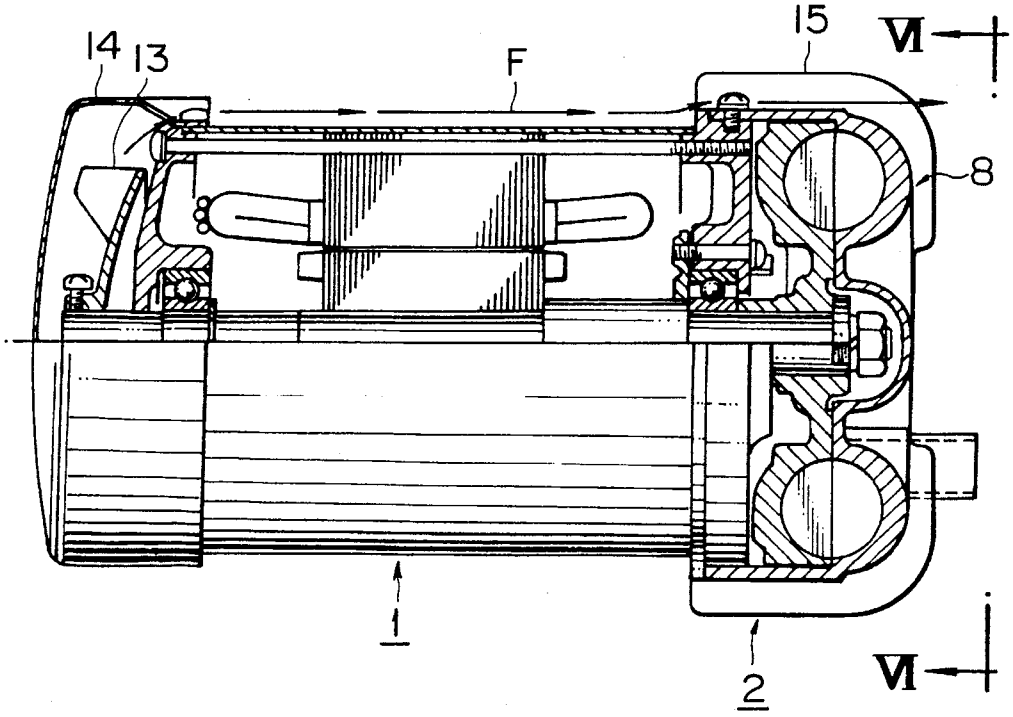
FIG. 5 is a partially cross-sectional view showing a third embodiment of the present invention.

In the embodiment of FIGS. 5 and 6, cooling fins 15 are mounted to the casing 8 to increase the contact area of the casing 8 and air, and to pass the cooling air F through spaces formed between the casing and the cooling fins 15, as shown by arrows in the drawing, thereby obtaining higher cooling effect. According to this embodiment, the temperature increase may be more sufficiently controlled.

According to this embodiment, the cooling fins 15 extend not only to outer regions of the casing 8 but also to the edge face of the casing 8 opposite to the edge adjacent the induction motor 1, thereby efficiently increasing the contact area and easily obtaining a higher cooling effect.

Figure 8:
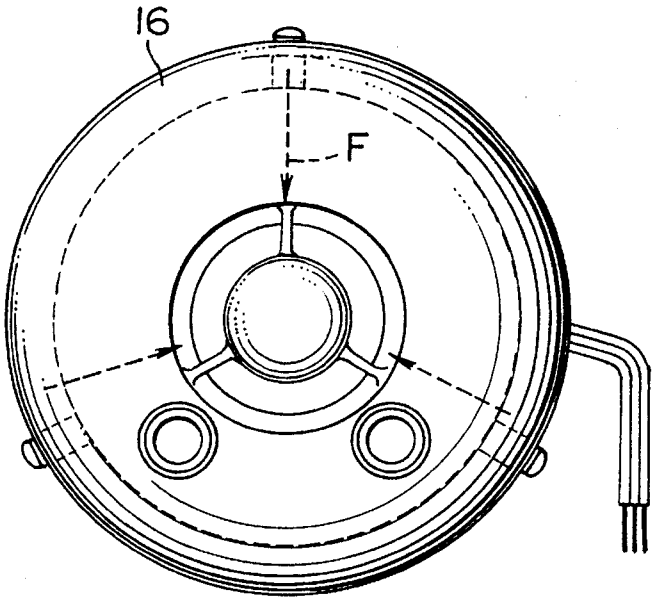
FIG. 8 is a side view of the embodiment of FIG. 7 viewed from the lines VIII—VIII.
Figure 7:
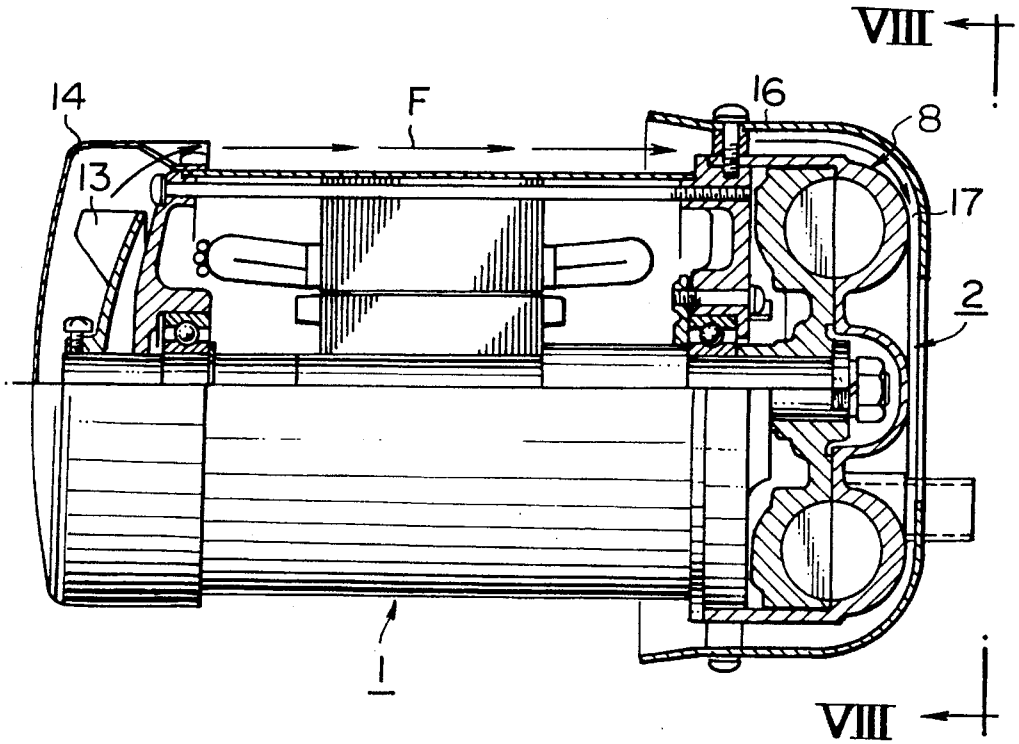
FIG. 7 is a partially cross-sectional view showing a fourth embodiment of the present invention.

In the embodiment of FIGS. 7 and 8, a casing cover 16 is mounted outside the casing 8 to cool the casing 8 more positively. The casing cover 16 forms an air guiding passage 17 for guiding the cooling air F to the edge face of the casing 8 opposite to that of the side of the induction motor 1, as shown by the arrows in the drawings. Therefore, the casing 8 may be efficiently cooled, and the temperature increase due to a reduction of the size may be securely controlled.

In this embodiment, the cooling fins 15 shown in the embodiment of FIG. 5 may be provided and combined with the casing cover 16 to obtain a cooling effect.

The mounting means of a vortex blower according to the present invention will be described.

Figure 10:
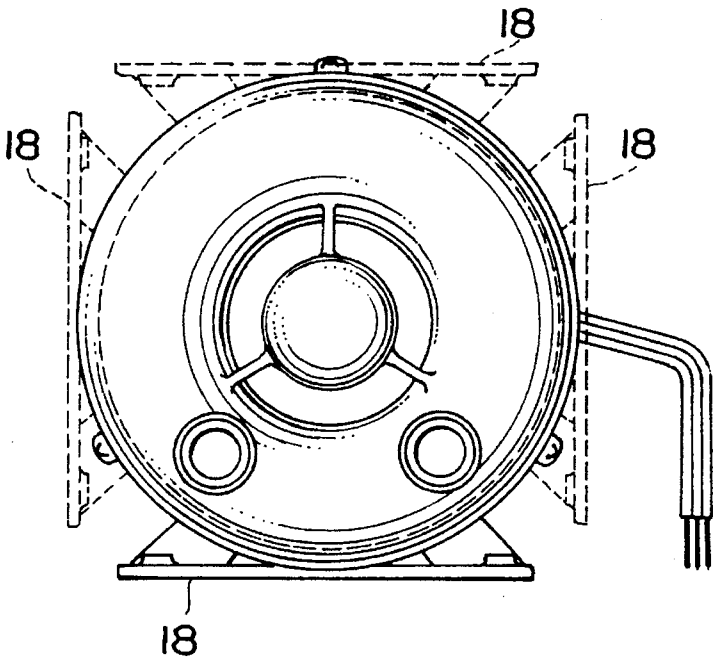
FIG. 10 is a side view of the embodiment of FIG. 9 viewed from the lines X—X.
Figure 9:
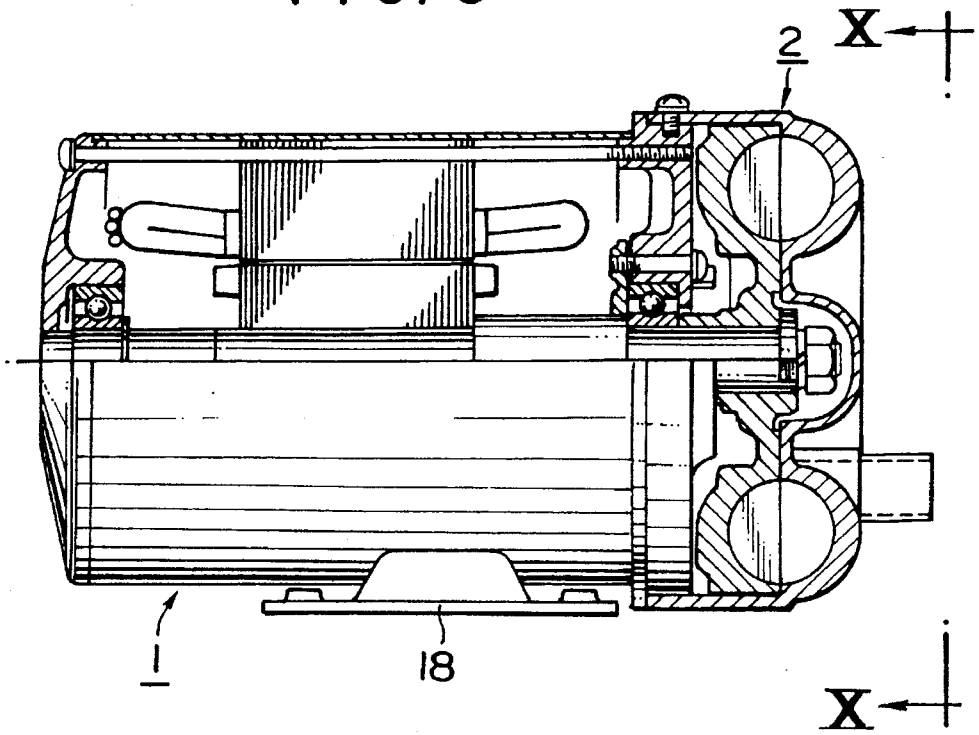
FIG. 9 is a partially cross-sectional view showing a fifth embodiment of the present invention.

Referring to FIGS. 9 and 10, in a vortex blower according to the present invention, the outer diameter of the blower portion 2 can be approximately the same as that of the induction motor 1. Therefore, as shown in the embodiment of FIG. 10, when the vortex blower is mounted by means of a trapezoid bracket 18 provided on the induction motor 1, the blower portion 2 does not interfere with mounting. The position of the trapezoid bracket 18 mounted to the induction motor 1 may be selected to be at any positions in relation to the inlet means 10 and the outlet means 11 of the blower portion 2. Therefore, the position of the vortex blower may be varied in accordance with use conditions, thereby keeping equipment layout in a most favorable state.

Figure 12:
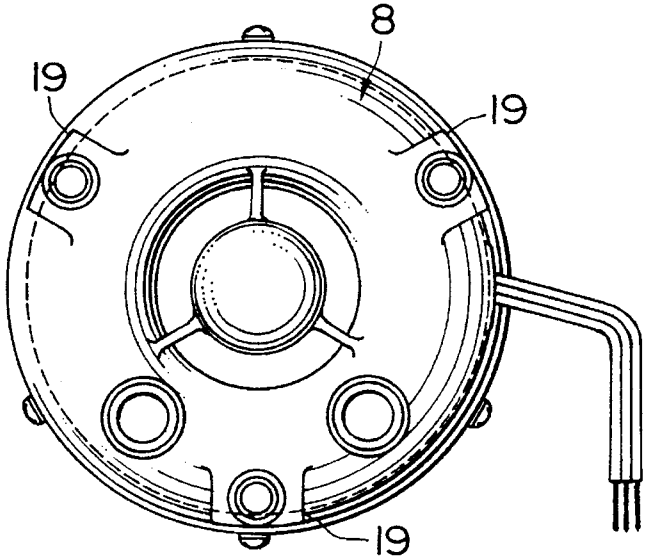
FIG. 12 is a side view of the embodiment of FIG. 11 viewed from the lines XII—XII.
Figure 11:
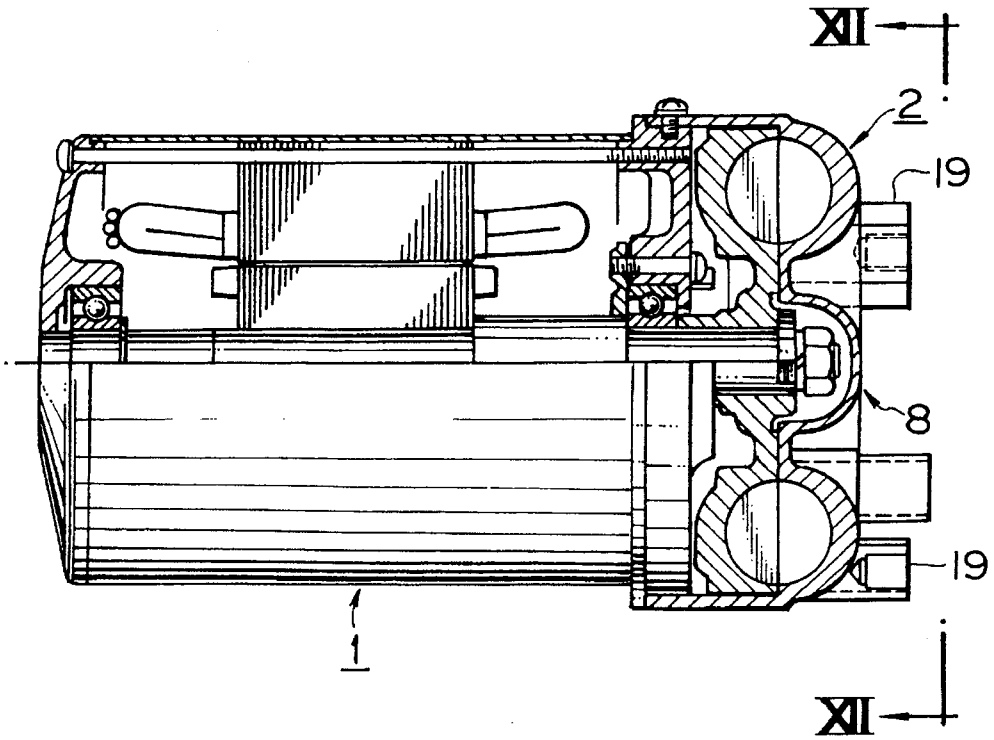
FIG. 11 is a partially cross-sectional view showing a sixth embodiment of the present invention.

FIGS. 11 and 12 show an embodiment of the present invention in which mounting members 19 of female thread-stud type are provided at the edge face of the casing 8 of the blower portion 2.

In case of a vertical installation of the vortex blower in which the rotary shaft 3 is perpendicular, provision of the mounting members 19 on the casing 8 of the blower portion 2 makes it possible to make the installation projected area of the vortex blower the same as that of a case when only the induction motor 1 is installed, together with a synergistic effect of the same outer diameters of the blower portion 2 and the induction motor 1. Therefore, according to this embodiment, the vortex blower can be easily and advantageously applied in a situation in which there is other sufficient installation space.

In this embodiment, three mounting members 19 are provided, but it is needless to say that the number of the mounting members is not limited to three.

Figure 13:
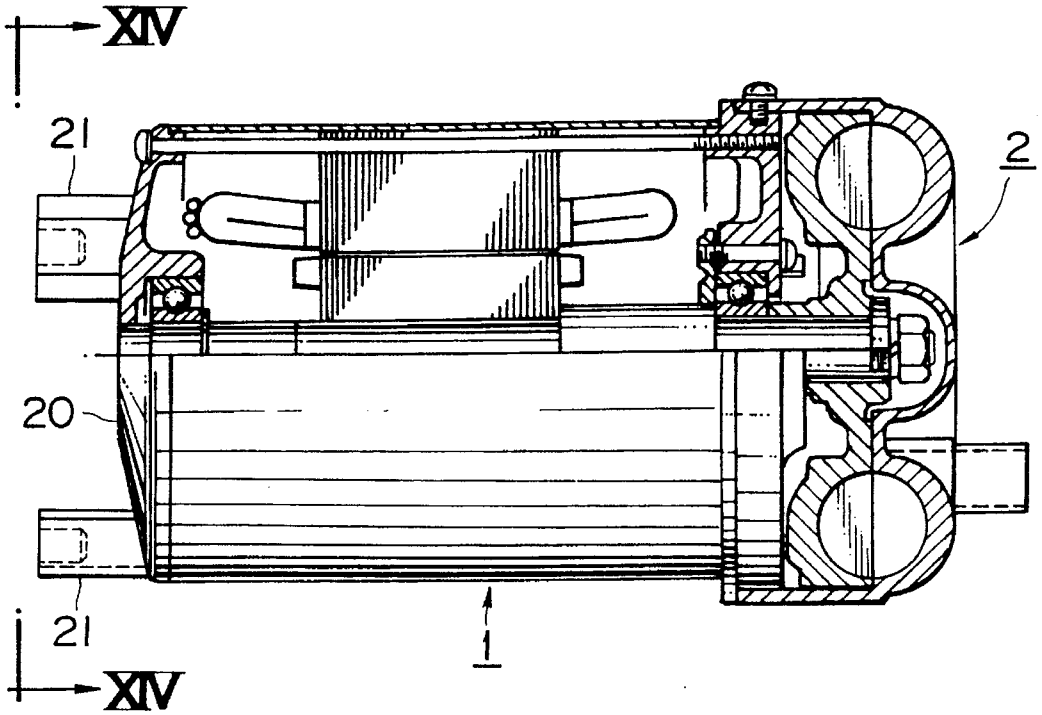
FIG. 13 is a partially cross-sectional view showing a seventh embodiment of the present invention.
Figure 14:
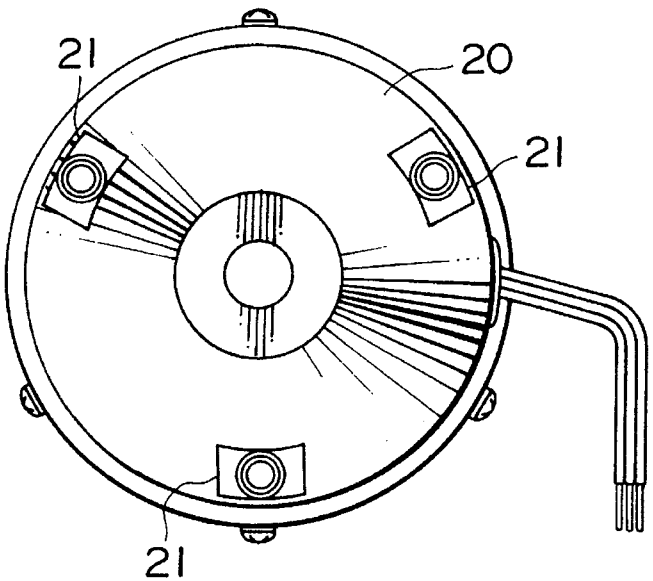
FIG. 14 is a side view of the embodiment of FIG. 13 viewed from the lines XIV—XIV.
Figure 16:
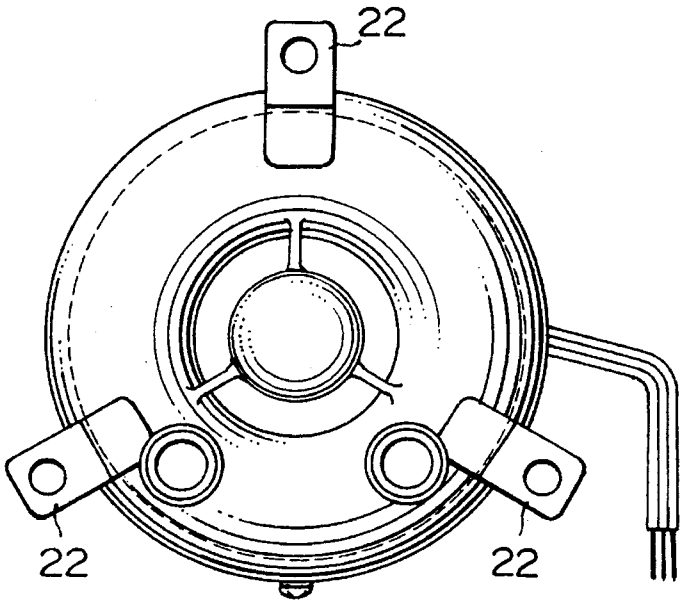
FIG. 16 is a side view of the embodiment of FIG. 15 viewed from the lines XVI—XVI.
Figure 15:
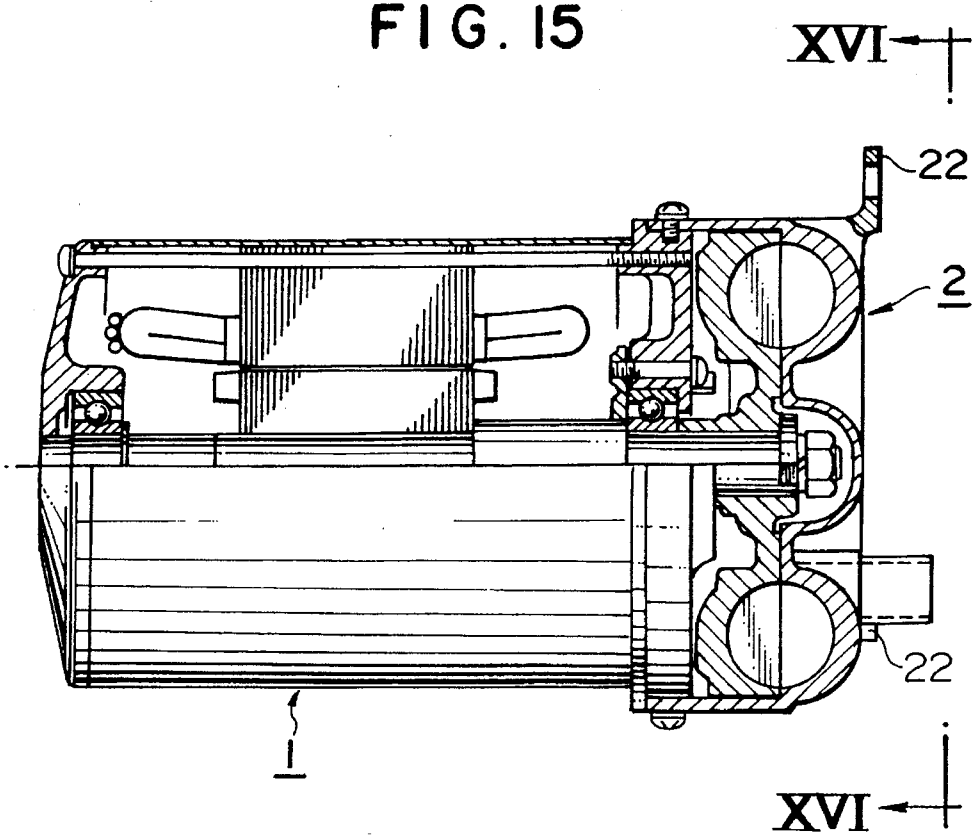
FIG. 15 is a partially cross-sectional view showing a eighth embodiment of the present invention.
Figure 17:
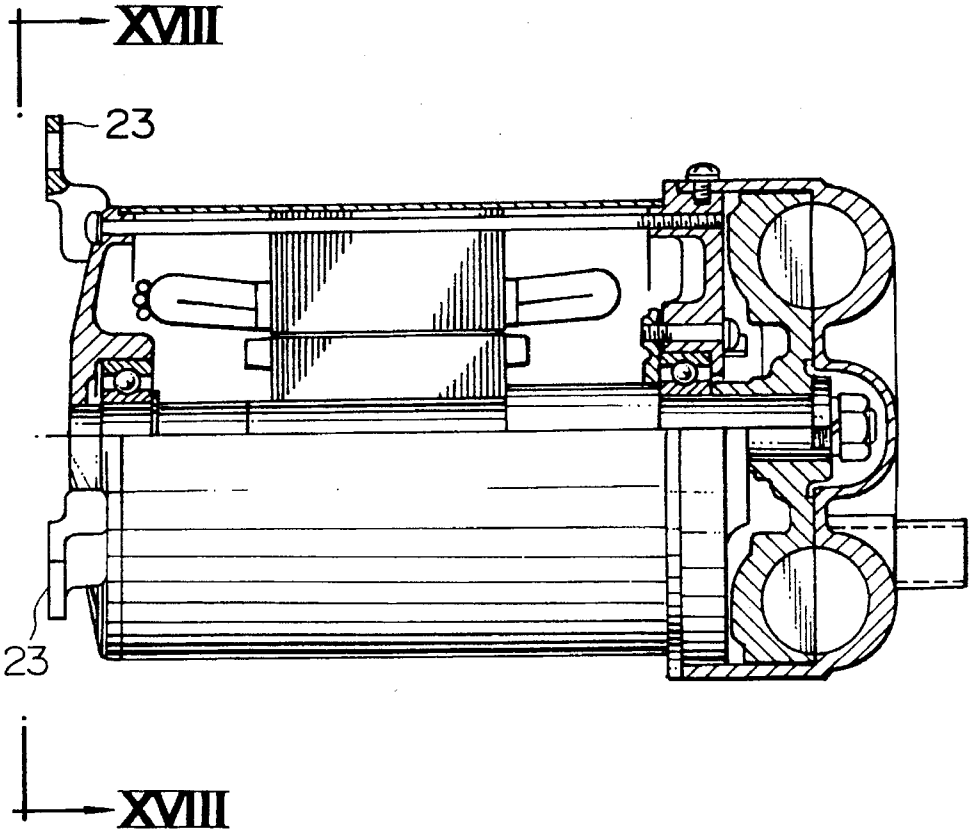
FIG. 17 is a partially cross-sectional view showing ninth embodiment of the present invention.
Figure 18:
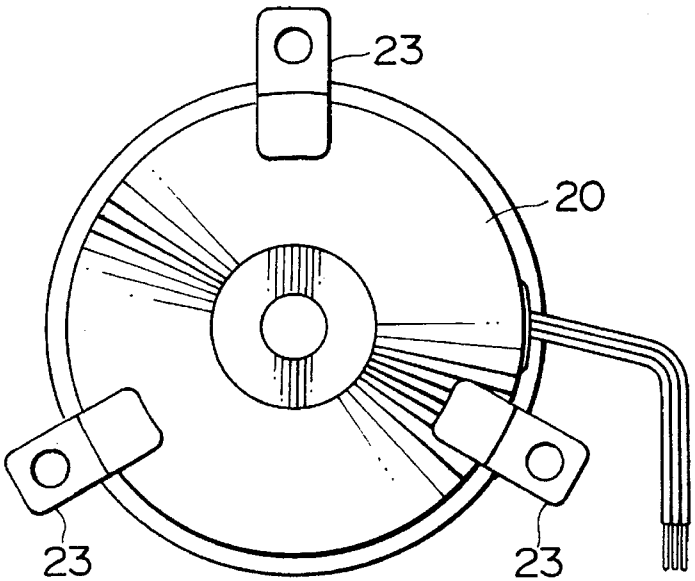
FIG. 18 is a side view of the embodiment of FIG. 17 viewed from the lines XVIII—XVIII.

FIGS. 13 and 14 show an embodiment of the present invention in which the mounting members 21 of female thread-stud type are provided on an end bracket 20 of the induction motor 1 opposite to the blower portion of the induction motor 1. This embodiment offers the same benefit as that in the embodiment of FIGS. 11 and 12 and is effective in a situation in which the vortex blower is turned upside down in relation to the installation location.

FIGS. 15 to 18 show embodiments of the present invention in which L-shaped mounting members 22 or 23 are provided instead of the mounting members 19 or 21 of female thread-stud type. In these embodiments, mounting areas required for installation of the vortex blower are relatively larger than those in the embodiments of FIGS. 11 to 14. However, these embodiments are effective to increase the degree of freedom for installing the vortex blower.

Figure 19:
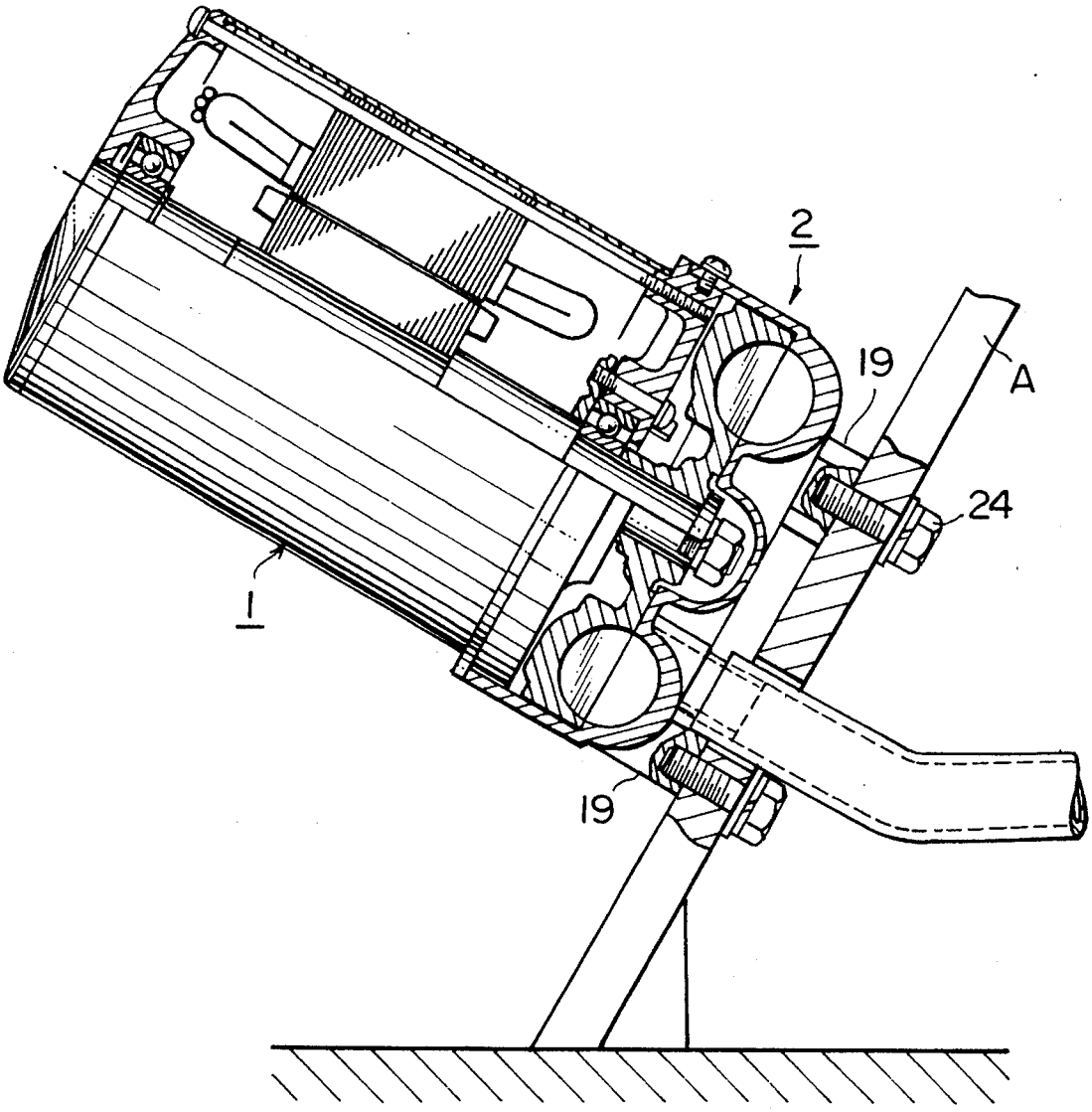
FIGS. 19 and 20 are front views each showing a respective mounting condition of a blower.

The mounting situation of these vortex blowers in use condition will be described. FIG. 19 shows a situation in which the vortex blower according to an embodiment of the present invention shown in FIGS. 11 and 12 is mounted on the surface of an installation member A at a fixed angle with respect to a horizontal plane, and FIG. 20 shows a case in which the vortex blower according to an embodiment of the present invention shown in FIGS. 13 and 14 is mounted on the surface of an installation member B which extends perpendicular to a horizontal surface.

In these cases, the induction motor 1 overhangs from the blower portion 2. However, according to the embodiment of the present invention, such vortex blower may be easily mounted by suitably selecting the size of the induction motor 1, strength of its housing, and strength of its connecting portion with the blower portion 2. Therefore, according to the embodiment of the present invention, the degree of freedom of the equipment layout may be further increased.

Figure 20:
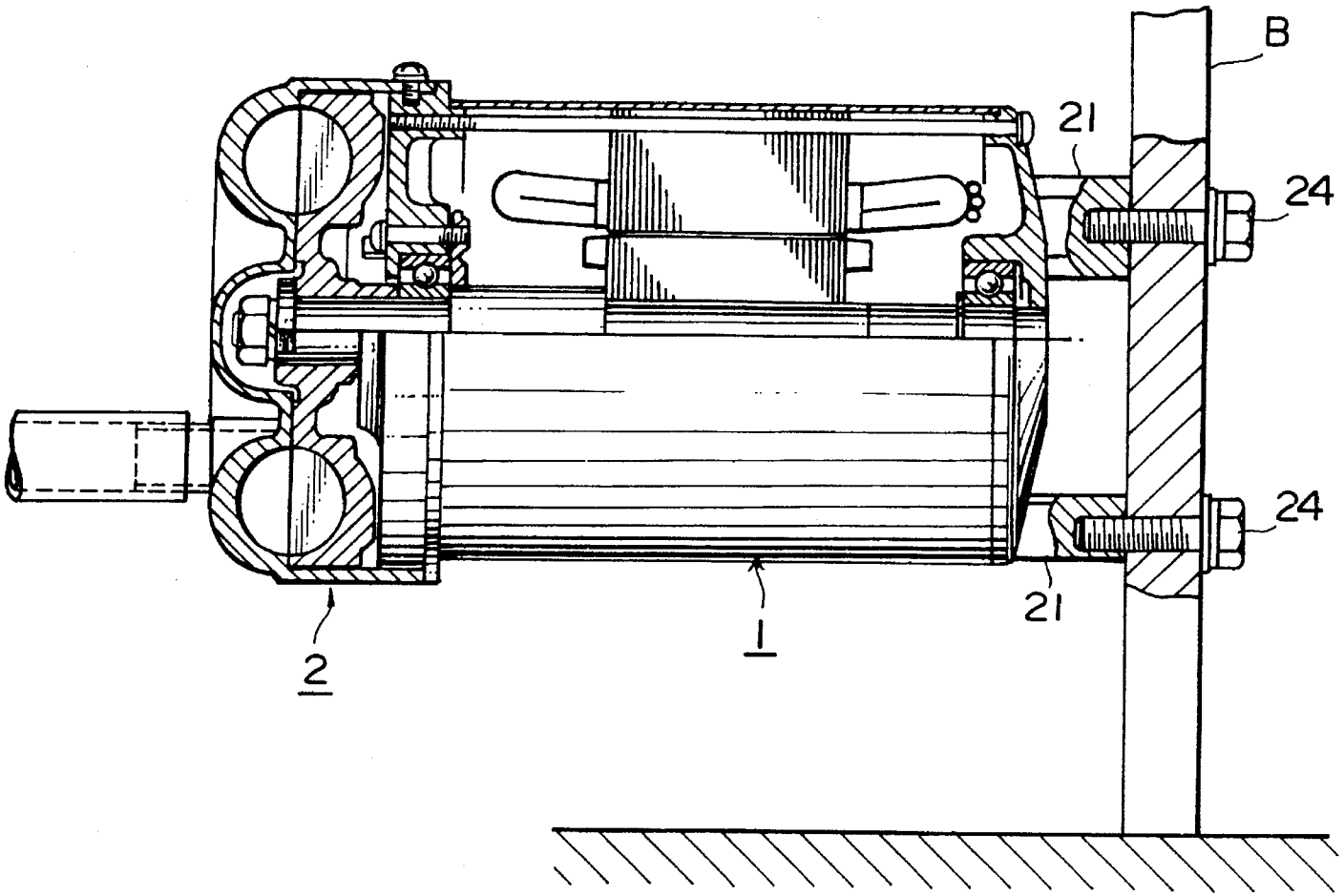

The examples of mounting shown in FIGS. 19 and 20 may be applied to the embodiments of FIGS. 15 to 18, and the degree of freedom of the equipment layout may be increased.

As factors for determining aerodynamic properties of the vortex blower, there may be mentioned the size and shape of the impeller 4, the shape of the casing 8, the area of the pressurizing duct 9, and the shape of the inlet means 10 and the outlet means 11. Among them, as factors relating to static pressure of the vortex blower, there may be particularly mentioned the outer diameter of the impeller 4 and the rotary speed thereof.

Figure 22:
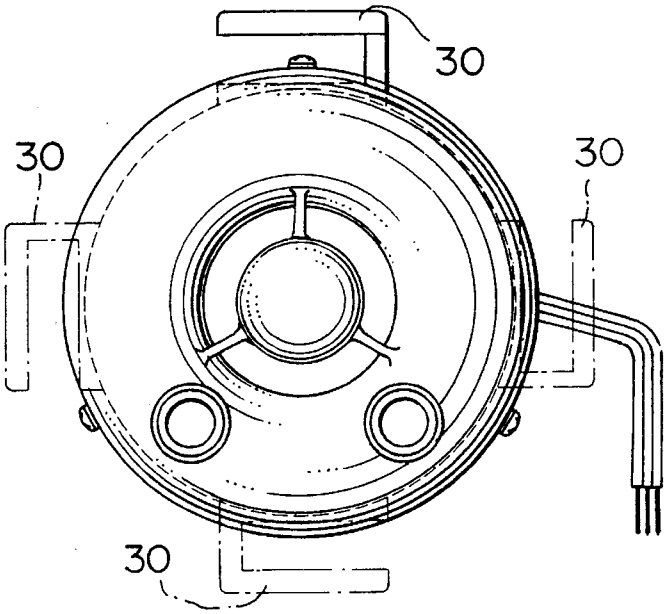
FIG. 22 is a side view of the embodiment of FIG. 21 viewed from the lines XXII—XXII.
Figure 21:
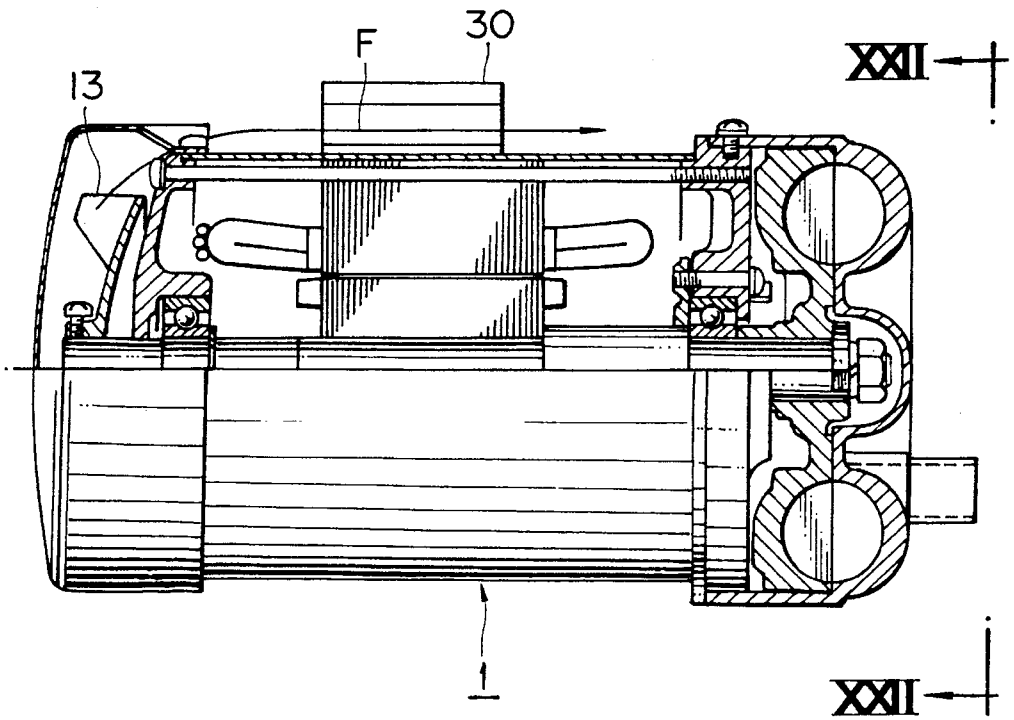
FIG. 21 is a partially cross-sectional view showing a tenth embodiment of the present invention.

Therefore, when a higher discharge pressure and a larger volume of air are required, the rotary speed of the impeller 4 may be increased. In the embodiment of FIGS. 21 and 22, frequency conversion is performed using an invertor 30 to increase the frequency of the power supplied to the induction motor 1 to a frequency higher than that of the power source.

Generally, the volume of air of the vortex blower is proportional to the rotary speed of the impeller, and the pressure is proportional to the square of the rotary speed.

Figure 23:
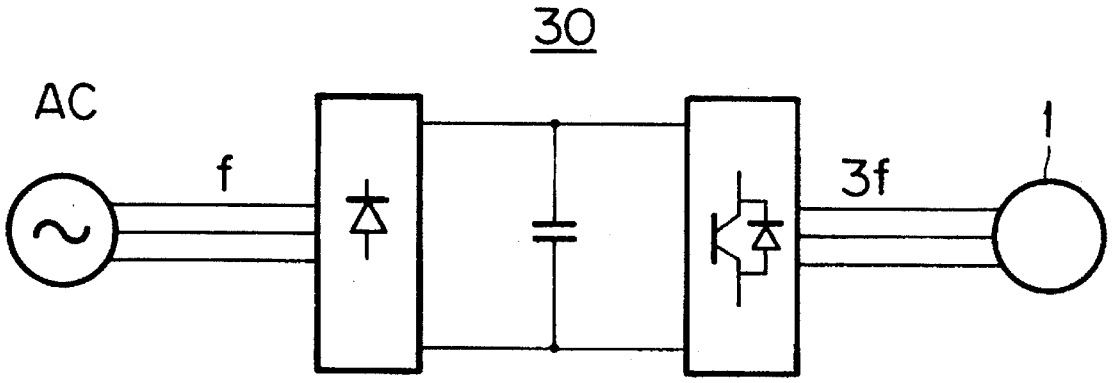
FIG. 23 is a wiring diagram showing an invertor in FIG. 21.

Thus, if the rotary speed is trebled, a pressure equivalent to two times the output of the induction motor 1, as compared with the conventional vortex blower, is obtained. In FIG. 23, when the frequency of a commercial power source AC is f (50 Hz or 60 Hz), the output frequency of the inverter 30 is 3f (150 Hz or 180 Hz). The inverter 30 and the vortex blower are formed as a integral unit. By this, in spite of using the inverter, the vortex blower may be operated as a single unit like a general vortex blower.

As shown in FIGS. 21 and 22, the inverter 30 is spaced apart from the housing of the induction motor 1 so that the flow of the cooling air F produced by the cooling fan 13 is not interrupted, and the inverter 30 itself is also cooled. The mounting position of the inverter 30 may be arbitrarily selected to eliminate restrictions due to the mounting situation at the place where the vortex blower is used.

Figure 27:
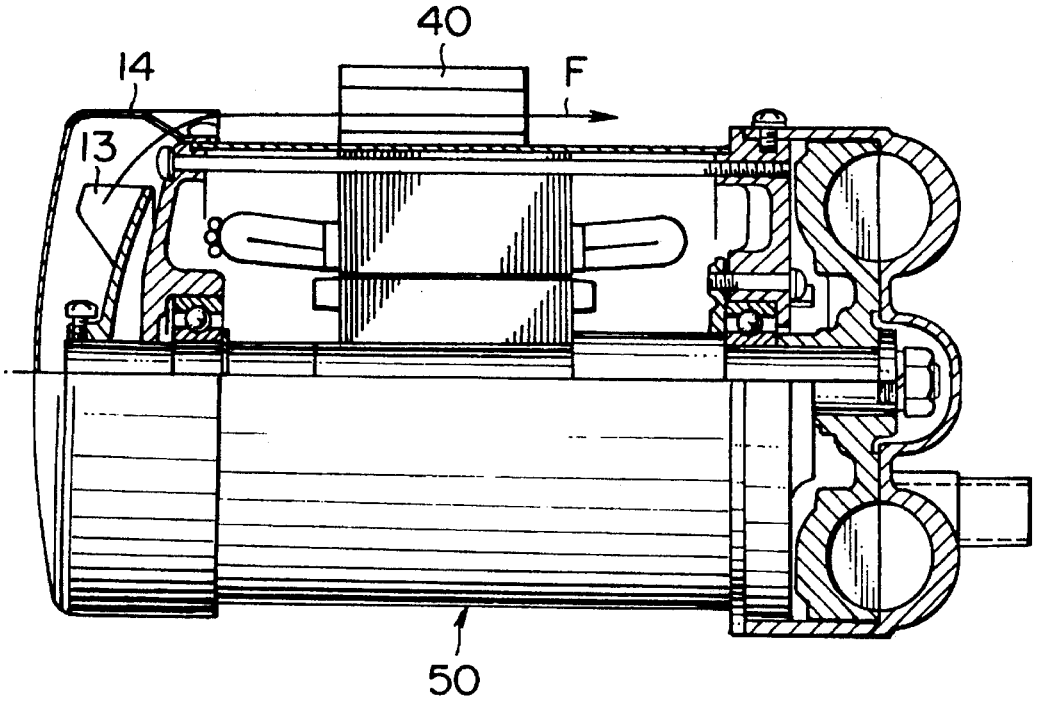

To obtain a high discharge pressure and a large volume of air, a direct current (DC) motor 50, instead of the induction motor 1, and a voltage controller 40, instead of the inverter 30, may be used, (see FIG. 27). In this case, the speed of the DC motor 50 may be increased by raising the voltage supplied to the DC motor 50 with the voltage controller 40, thereby obtaining a high discharge pressure and a large volume of air.

Figure 24:
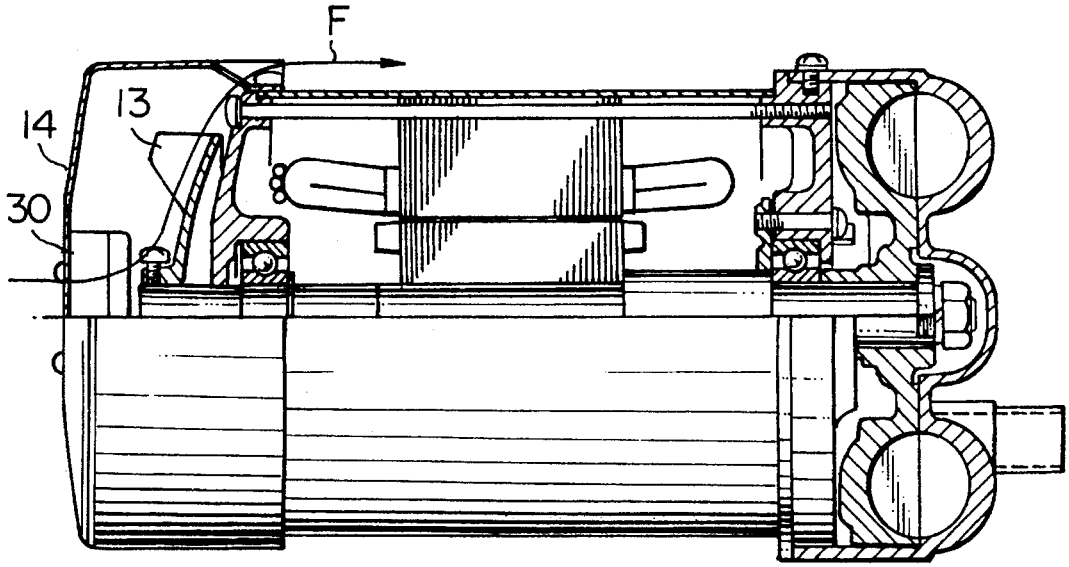
FIGS. 24 to 27 are partially cross-sectional views each showing another embodiment of the present invention.
Figure 25:
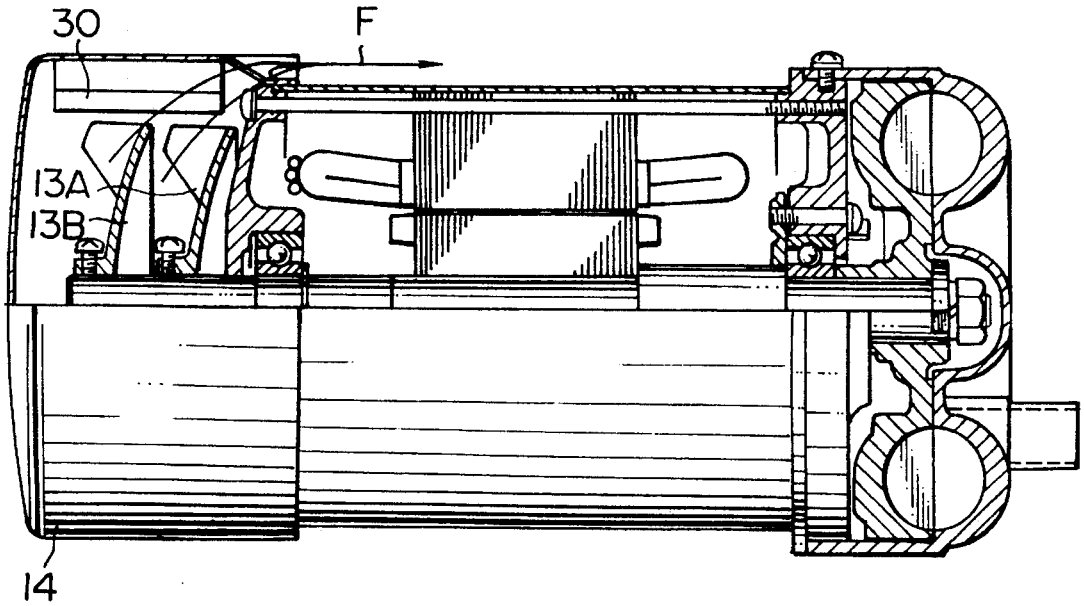
Figure 26:
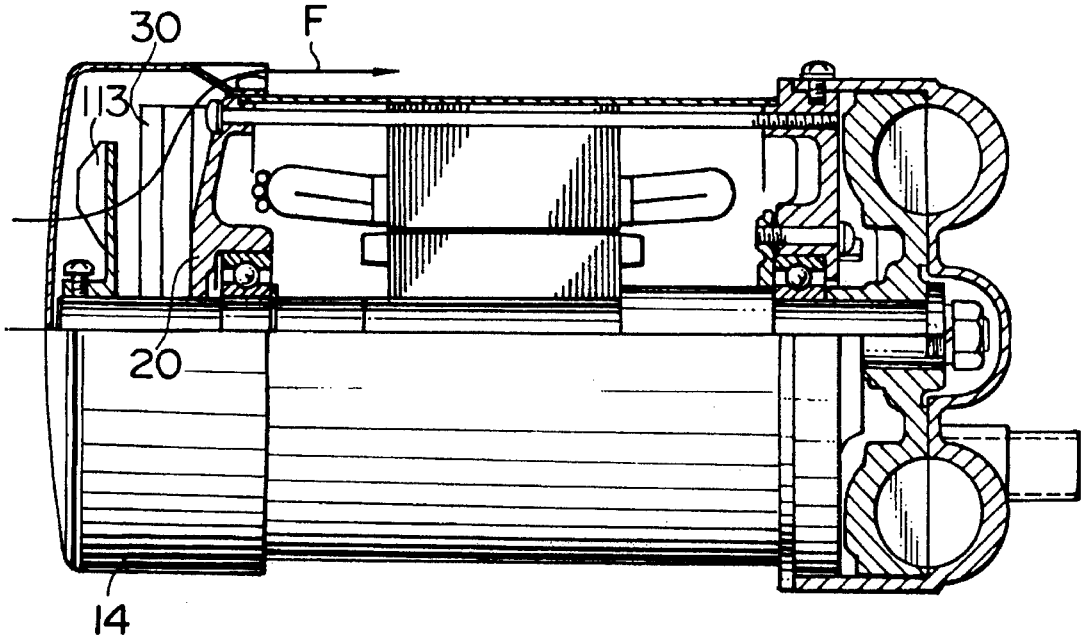

FIGS. 24 to 26 each show an embodiment in which the inverter 30 is installed inside an end cover 14 of the induction motor 1 to obtain a cooling effect.

FIG. 24 shows an embodiment in which a cooling effect is obtained by utilizing the intake air of the cooling fan 13.

FIG. 25 shows an embodiment in which a cooling effect is obtained by utilizing the cooling air F from the cooling fans 13.

FIG. 26 shows an embodiment in which an axial fan 113 is used as the cooling fan, instead of a generally used mixed flow impeller, to permit mounting of the inverter 30 on the end bracket 20 of the induction motor 1.

What is claimed is:

1. A vortex blower comprising:

motor means including a housing, a rotor and a stator enclosed within said housing, a bearing in one end of said housing, and an output rotary shaft extending from said rotor, through said bearing and outside said housing, for transmitting rotary motion of said rotor;

a casing covering said one end of said housing and said output rotary shaft, said casing having a first groove therein, and an inlet and an outlet communicating with said first groove; and an impeller disposed outside said housing and within said casing, said impeller having a second groove therein facing said first groove, and having a plurality of blades extending radially within said second groove to partition said second groove into a plurality of sections, said second groove cooperating with said first groove to define a working chamber for pressurizing air, said impeller being connected to said output rotary shaft to rotate therewith, to draw air through said inlet into said working chamber, pressurize the air within said working chamber, and discharge the pressurized air from said working chamber through said outlet.

2. A vortex blower according to claim 1, wherein said motor means comprises a DC (direct current) motor and a controller for controlling voltage supplied to said DC motor.

3. A vortex blower according to claim 1, wherein said motor means comprises an induction motor and an invertor for controlling the frequency of power supplied to said induction motor.

4. A vortex blower according to claim 1, wherein said inlet and said outlet are disposed axially opposite said impeller.

5. A vortex blower according to claim 4, wherein said inlet and said outlet extend axially.

6. A vortex blower according to claim 1, wherein said second groove has a cross-section with rounded bottom corners.

7. A vortex blower according to claim 6, wherein said cross-section is one of semi-circular and semi-elliptical.

8. A vortex blower according to claim 6, wherein said cross-section includes a straight bottom portion and two quarter-circular corner portions connected to respective opposite ends of said straight bottom portion.

* * * * *